US008642239B2

(12) United States Patent
Hong et al.

(10) Patent No.: US 8,642,239 B2
(45) Date of Patent: Feb. 4, 2014

(54) TONER FOR DEVELOPING ELECTROSTATIC CHARGE IMAGE, METHOD OF PREPARING THE SAME, DEVICE FOR SUPPLYING THE SAME, AND APPARATUS AND METHOD FOR FORMING IMAGE USING THE SAME

(75) Inventors: Jin-mo Hong, Yongin-si (KR); Takeshi Yoshida, Suwon-si (KR); Sung-jin Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 103 days.

(21) Appl. No.: 13/347,141

(22) Filed: Jan. 10, 2012

(65) Prior Publication Data

US 2012/0196218 A1 Aug. 2, 2012

(30) Foreign Application Priority Data

Jan. 31, 2011 (KR) ..... 10-2011-0009496

(51) Int. Cl.
*G03G 9/08* (2006.01)

(52) U.S. Cl.
USPC ..... 430/110.2; 430/109.4; 430/137.11; 430/137.12; 399/252

(58) Field of Classification Search
USPC ..... 430/110.2, 109.4, 137.11, 137.12; 399/252
See application file for complete search history.

(56) References Cited

U.S. PATENT DOCUMENTS

| | | | | |
|---|---|---|---|---|
| 6,617,091 | B2 | 9/2003 | Nishimori et al. | |
| 2004/0132920 | A1* | 7/2004 | Matsumura et al. | 525/418 |
| 2012/0052433 | A1* | 3/2012 | Chen et al. | 430/108.4 |

* cited by examiner

*Primary Examiner* — Mark A Chapman
(74) *Attorney, Agent, or Firm* — Staas & Halsey LLP

(57) ABSTRACT

A toner for developing an electrostatic charge image includes a core layer including a first binder resin, a colorant and a releasing agent; and a shell layer coating the core layer and including a second binder resin. The first binder resin of the core layer includes a low molecular weight amorphous polyester resin having a weight-average molecular weight of about 6000 g/mol to about 20000 g/mol, a high molecular weight amorphous polyester resin having a weight-average molecular weight of about 25000 g/mol to about 100000 g/mol, and a crystalline polyester resin having a weight-average molecular weight of about 8000 g/mol to about 30000 g/mol. The second binder resin of the shell layer includes the low and high molecular weight amorphous polyester resins.

17 Claims, 2 Drawing Sheets

TONER FOR DEVELOPING ELECTROSTATIC CHARGE IMAGE, METHOD OF PREPARING THE SAME, DEVICE FOR SUPPLYING THE SAME, AND APPARATUS AND METHOD FOR FORMING IMAGE USING THE SAME

CROSS-REFERENCE TO RELATED APPLICATIONS

This application claims the benefit of Korean Patent Application No. 10-2011-0009496, filed on Jan. 31, 2011, in the Korean Intellectual Property Office, the disclosure of which is incorporated herein in its entirety by reference.

BACKGROUND

1. Field

The present disclosure relates to a toner for developing an electrostatic charge image, a method of preparing the same, a device for supplying the same, and an apparatus and a method of forming the image using the same.

2. Description of the Related Art

A method of preparing toner particles suitable for use in an electrophotographic process and an electrostatic image recording process may be largely classified into a pulverization method and a polymerization method.

Conventionally, toners used for image-forming apparatuses are mainly prepared through the pulverization method. Since the precise control of toner particle size, narrow particle size distribution, and toner shape is difficult in terms of the pulverization method, it is difficult to independently design each important property required for a toner such as charging, fixation, fluidity, or storage ability.

Therefore, in order to cope with the recent requirements of high quality, high reliability, and high productivity for a multi-functional digital color printer and other color printers, a polymerized toner has attracted interest because control of particle diameter and shape is easy and performance of a complex manufacturing process such as classification is not necessary. When a toner is manufactured by using the polymerization method, a polymerized toner having a desired particle size and particle size distribution may be obtained without pulverizing or classification. Since a toner manufactured by using the polymerization method has a smaller particle diameter, narrower particle size distribution, better circularity, and easier control of morphology than one manufactured by the pulverization method, the polymerized toner has advantages such as high charging and transfer efficiency, high resolution through good dot reproducibility and line reproducibility, wide color gamut, low toner consumption, and high image quality. In typical polymerized toners, copolymer resins of styrene and an acrylate were mainly used as a binder resin, but improvements in transparency and low-temperature fixation of the binder resin are required according to a recent increase in application areas of color toners.

To obtain the foregoing properties, toner particles were suggested in U.S. Pat. No. 6,617,091. The suggested toner particles has a resin layer (shell) formed on a surface of a colored particle (core particle) containing a resin and a colorant in order to provide a polymerized toner which has a less amount of colorant on the surface of the particle and does not generate changes in image concentration, fogging, and color changes of color image caused by changes in chargeability and developability even if the toner particles are used to form images under highly humid conditions over an extended period of time. This method may improve charge uniformity between colors to some extent by suppressing exposure of pigments to the surface of the toner particles. However, for example, when a lot of wax is contained, heat storage ability and fluidity of the toner may be reduced because of a plasticizing effect caused by some degree of miscibility between a low molecular weight portion of the wax and the resin. Also, for low-temperature fixation, a method is being suggested, in which the surface of a binder resin having a low glass transition temperature (Tg) is encapsulated with a binder resin having a relatively high Tg. However, this method may achieve the objective of the low-temperature fixation, but heat storage ability and gloss are not sufficient.

SUMMARY

Additional aspects and/or advantages will be set forth in part in the description which follows and, in part, will be apparent from the description, or may be learned by practice of the invention.

The present disclosure provides a toner for developing an electrostatic charge image, which may have a certain level of characteristics such as low-temperature fixability, fluidity, heat storage ability and gloss.

The present disclosure also provides a method of preparing a toner for developing an electrostatic charge image having the above characteristics.

The present disclosure also provides a toner supply device employing a toner for developing an electrostatic charge image having the above characteristics.

The present disclosure also provides an apparatus for forming an image by using a toner for developing an electrostatic charge image having the above characteristics.

The present disclosure also provides a method of forming an image by using a toner for developing an electrostatic charge image having the above characteristic.

According to an aspect of the present disclosure, there is provided a toner for developing an electrostatic charge image including: a core layer including a first binder resin, a colorant and a releasing agent; and a shell layer coating the core layer and including a second binder resin, wherein the first binder resin of the core layer may include a low molecular weight amorphous polyester resin having a weight-average molecular weight of about 6,000 g/mol to about 20,000 g/mol, a high molecular weight amorphous polyester resin having a weight-average molecular weight of about 25,000 g/mol to about 100,000 g/mol, and a crystalline polyester resin having a weight-average molecular weight of about 8,000 g/mol to about 30,000 g/mol, the second binder resin of the shell layer may include the low and high molecular weight amorphous polyester resins, and the toner may exhibit a rheological behavior satisfying the following equations (1), (2) and (3) according to a temperature change:

$$0.01<S\kappa<0.04, 0.05<S\lambda<0.2, \text{ and } 2<S\lambda/S\kappa<20, \quad (1)$$

where, $S\kappa=[\log G'(40° C.)-\log G'(50° C.)]/10$ and $S\lambda=[\log G'(50° C.)-\log G'(60° C.)]/10$, $$0.1<S\sigma<0.2 \text{ and } 0.06<S\tau<0.1, \quad (2)$$

where, $S\sigma=[\log G'(60° C.)-\log G'(70° C.)]/10$ and $S\tau=[\log G'(70° C.)-\log G'(80° C.)]/10$, and $$70° C.<Tp<80° C., 1\times10^5 \text{ Pa}<G'p<5\times10^5 \text{ Pa}, \quad (3)$$

where, Tp denotes a temperature satisfying a condition (a p condition) of $S\sigma/S\tau>1$, G'p denotes a shear storage modulus at a temperature satisfying the p condition, and G'(temperature) denotes a shear storage modulus (unit: Pa) measured under conditions including a measurement frequency of about 6.28 rad/s, a heating rate of about 2.0° C./min, an initial strain of about 0.3% and an indicated temperature.

The binder resins may have a mixing ratio satisfying a condition of the following equation (4), and the high molecular weight amorphous polyester resin and the low molecular weight amorphous polyester resin have a molecular weight difference satisfying a condition of the following equation (5):

$$1<[\alpha L]/[\alpha H]<4 \text{ and } 2<([\alpha L]+[\alpha H])/[\beta]<30, \text{and} \quad (4)$$

$$0.3<(\log M_H-\log M_L)<1, \quad (5)$$

where, $[\alpha_L]$ and $[\alpha_H]$ denote weights of the high molecular weight amorphous polyester resin and the low molecular weight amorphous polyester resin in the toner, respectively, $[\beta]$ denotes a weight of the crystalline polyester resin in the toner, and $M_H$ and $M_L$ are weight-average molecular weights of the high molecular weight amorphous polyester resin and the low molecular weight amorphous polyester resin, respectively.

The toner may exhibit a rheological behavior further satisfying a condition of the following equation (6) according to a temperature change:

$$0<[\log G'(120° \text{ C.})-\log G'(140° \text{ C.})]/20<0.05.$$

The toner may have a weight-average molecular weight of about 20000 g/mol to about 60000 g/mol determined from a molecular weight measurement by using a gel permeation chromatography (GPC) method on a tetrahydrofuran (THF) soluble fraction.

A volume average particle diameter of the toner may be in a range of about 3 μm to about 9.5 μm.

An average circularity of the toner may be in a range of about 0.940 to about 0.985.

Values of GSDv and GSDp of the toner may be about 1.25 or less and about 1.30 or less, respectively.

The releasing agent may include a paraffin-based wax and an ester-based wax, a weight ratio of the ester-based wax may be in a range of about 1 wt % to about 50 wt % based on a total weight of the paraffin-based wax and the ester-based wax, and solubility parameter (SP) values of the binder resins may have a difference of 2 or more when compared with SP values of the paraffin-based wax and the ester-based wax.

The toner may further include a coagulant including silicon (Si) and iron (Fe), and when a silicon intensity and an iron intensity determined by X-ray fluorescence (XRF) measurements are denoted as [Si] and [Fe], a [Si]/[Fe] ratio may satisfy the following condition (7):

$$0.0005\leq[\text{Si}]/[\text{Fe}]\leq0.05. \quad (7)$$

The toner particles may have less than about 3 wt % of fine particles with a diameter of less than about 3 μm, and less than about 0.5 wt % of coarse particles with a diameter of about 16 μm or more.

According to another aspect of the present disclosure, there is provided a method for preparing a toner for developing an electrostatic charge image including: preparing a mixture by mixing a first binder resin latex, a colorant, and a releasing agent, wherein the first binder resin includes a low molecular weight amorphous polyester resin having a weight-average molecular weight of about 6,000 g/mol to about 20,000 g/mol, a high molecular weight amorphous polyester resin having a weight-average molecular weight of about 25,000 g/mol to about 100,000 g/mol, and a crystalline polyester resin having a weight-average molecular weight of about 8,000 g/mol to about 30,000 g/mol; adding a coagulant into the mixture to form core particles including the first binder resin, the colorant and the releasing agent; forming shell layers on the core particles by adding a second binder resin latex in a dispersion of the core particles and adhering the second binder resin on surfaces of the core particles to form fine particles including the core and shell layers, wherein the second binder resin includes the low and high molecular weight amorphous polyester resins; additionally aggregating the fine particles until an average particle size of the fine particles reaches a range of about 70% to about 100% of an average target particle diameter of final toner particles; coalescing the aggregated fine particles in a temperature range of about 20° C. to about 50° C. higher than a glass transition temperature (Tg) of the amorphous polyester; and obtaining a final toner by further aggregating and coalescing the fine particles in a temperature range of Tg of the amorphous polyester or less, wherein the low molecular weight amorphous polyester resin, the high molecular weight amorphous polyester resin and the crystalline polyester resin satisfy the following mixing ratio when forming the core and shell layers by using the first and second binder resin latexes:

$$1<[\alpha_L]/[\alpha_H]<4 \text{ and } 2<([\alpha_L]+[\alpha_H])/[\beta]<30.$$

Here, $[\alpha_L]$ and $[\alpha_H]$ denote weights of the high molecular weight amorphous polyester resin and the low molecular weight amorphous polyester resin in the toner, respectively, and $[\beta]$ denotes a weight of the crystalline polyester resin in the toner.

According to another aspect of the present disclosure, there is provided a method for preparing a toner for developing an electrostatic charge image including: preparing a mixture by mixing a first binder resin latex, a colorant, and a releasing agent, wherein the first binder resin includes a low molecular weight amorphous polyester resin having a weight-average molecular weight of about 6,000 g/mol to about 20,000 g/mol, a high molecular weight amorphous polyester resin having a weight-average molecular weight of about 25,000 g/mol to about 100,000 g/mol, and a crystalline polyester resin having a weight-average molecular weight of about 8,000 g/mol to about 30,000 g/mol; adding a coagulant into the mixture to form core particles including the first binder resin, the colorant and the releasing agent; forming shell layers on the core particles by adding a second binder resin latex in a dispersion of the core particles and adhering the second binder resin on surfaces of the core particles to form fine particles including the core and shell layers, wherein the second binder resin includes the low and high molecular weight amorphous polyester resins; aggregating the fine particles in a temperature range having shear storage moduli (G') of the first and second binder resins ranging from about $1.0\times10^8$ Pa to about $1.0\times10^9$ Pa; stopping an aggregation reaction when an average particle size of the fine particles reaches a range of about 70% to about 100% of an average target particle size of final toner particles; coalescing the aggregated fine particles in a temperature range having shear storage moduli (G') of the first and second binder resins ranging from about $1.0\times10^4$ Pa to about $1.0\times10^7$ Pa; and obtaining a final toner by further aggregating and coalescing the fine particles in a temperature range having shear storage moduli (G') of the first and second binder resins ranging from about $1.0\times10^4$ Pa to about $1.0\times10^9$ Pa, wherein the low molecular weight amorphous polyester resin, the high molecular weight amorphous polyester resin and the crystalline polyester resin satisfy the following mixing ratio when the forming of the core and shell layers using the first and second binder resin latexes:

$$1<[\alpha_L]/[\alpha_H]<4 \text{ and } 2<([\alpha_L]+[\alpha_H])/[\beta]<30.$$

Here, $[\alpha_L]$ and $[\alpha_H]$ denote weights of the high molecular weight amorphous polyester resin and the low molecular weight amorphous polyester resin in the toner, respectively, and $[\beta]$ denotes a weight of the crystalline polyester resin in the toner.

The final toner may exhibit a rheological behavior satisfying the following equations (1), (2) and (3) according to a temperature change:

$$0.01<S\kappa<0.04, 0.05<S\lambda<0.2, \text{ and } 2<S\lambda/S\kappa<20, \quad (1)$$

where, $S\kappa=[\log G'(40° C.)-\log G'(50° C.)]/10$ and $S\lambda=[\log G'(50° C.)-\log G'(60° C.)]/10$, $$0.1<S\sigma<0.2 \text{ and } 0.06<S\tau<0.1, \quad (2)$$

where, $S\sigma=[\log G'(60° C.)-\log G'(70° C.)]/10$ and $S\tau=[\log G'(70° C.)-\log G'(80° C.)]/10$, and $$70° C.<Tp<80° C., 1\times10^5 \text{ Pa}<G'p<5\times10^5 \text{ Pa}, \quad (3)$$

where, Tp denotes a temperature satisfying a condition (a p condition) of $S\sigma/S\tau>1$, G'p denotes a shear storage modulus at a temperature satisfying the p condition, and G'(temperature) denotes a shear storage modulus (unit: Pa) measured under conditions including an angular velocity of about 6.28 rad/s, a heating rate of about 2.0° C./min, and an indicated temperature.

The binder resins may have a mixing ratio satisfying a condition of the following equation (4), and the high molecular weight amorphous polyester resin and the low molecular weight amorphous polyester resin may have a molecular weight difference satisfying a condition of the following equation (5):

$$1<[\alpha_L]/[\alpha_H]<4 \text{ and } 2<([\alpha_L]+[\alpha_H])/[\beta]<30, \text{ and} \quad (4)$$

$$0.3<(\log M_H-\log M_L)<1, \quad (5)$$

where, $[\alpha_L]$, $[\alpha_H]$, $M_H$ and $M_L$ are the same as defined above.

According to another aspect of the present disclosure, there is provided a toner supply device including: a toner tank to store a toner; a supplying part protruding toward an inner side of the toner tank to supply the stored toner to outside; and a toner stirring member rotatably installed inside the toner tank and configured to stir the toner in an entire inner space of the toner tank including an upper portion of the supplying part, wherein the toner is for developing an electrostatic charge image according to the present disclosure.

According to another aspect of the present disclosure, there is provided an apparatus forming an image including: an image carrier; an image forming device forming a latent image on a surface of the image carrier; a toner storage device to store a toner; a toner supply device to supply the toner to the surface of the image carrier to develop the latent image to a toner image on the surface of the image carrier; and a toner transfer device to transfer the toner image from the surface of the image carrier to an image receiving member, wherein the toner is for developing an electrostatic charge image according to the present disclosure.

According to another aspect of the present disclosure, there is provided a method for forming an image including adhering a toner to a surface of an image carrier on which an electrostatic latent image is formed to form a visible image and transferring the visible image to an image receiving member, wherein the toner is for developing an electrostatic charge image according to the present disclosure.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Figure 1:
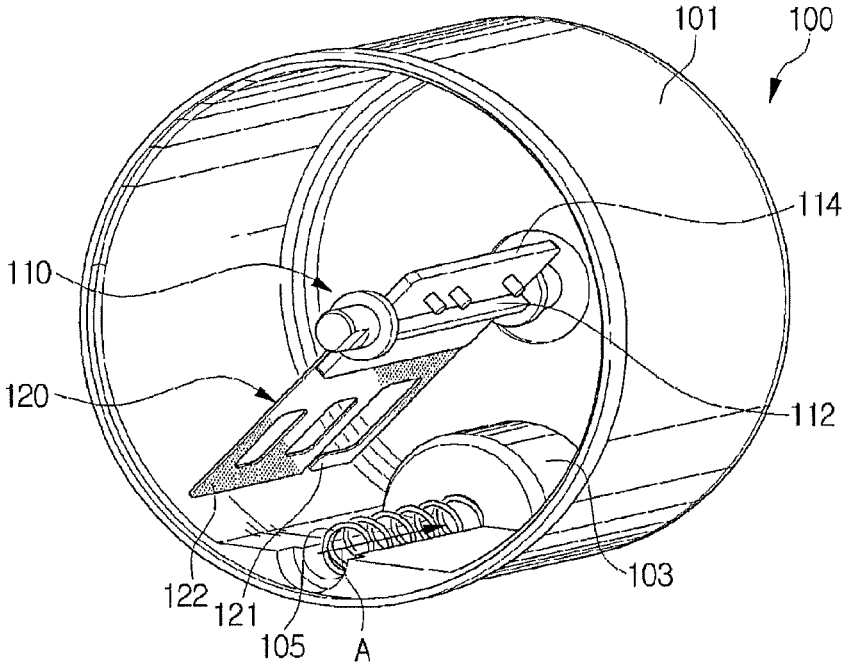
FIG. 1 is a perspective view illustrating a toner supply device according to an exemplary embodiment of the present disclosure.

The present disclosure will now be described more fully with reference to the accompanying drawings, in which exemplary embodiments of the present disclosure are shown.

Hereinafter, a toner for developing an electrostatic charge image, a method of preparing the toner, a toner supply device and an apparatus for forming the image according to an exemplary embodiment of the present disclosure will be described in detail.

A toner for developing an electrostatic charge image according to the present disclosure may exhibit excellent rheological behavior by using a binder resin in which a crystalline polyester resin having sharp melting characteristics is further combined with low and high molecular weight amorphous polyester resins having high intermolecular interaction in order to attain a high glass transition temperature enabling low-temperature fixation. Accordingly, since the present toner may have a certain level of characteristics such as anti-offset property, low-temperature fixability, charge stability, fluidity, heat storage ability, a wide color gamut, high resolution, and gloss, excellent image characteristics may be achieved, wide fixing region may be secured and durability may be improved. Therefore, the present toner is useful for developing an electrostatic charge image of an electrophotographic copier, a laser printer, and an electrostatic image recording apparatus, etc.

Specifically, a toner for developing an electrostatic charge image according to the present disclosure has a core layer including a first binder resin, a colorant and a releasing agent, and a shell layer coating the core layer and including a second binder resin, wherein the first binder resin of the core layer includes a low molecular weight amorphous polyester resin having a weight-average molecular weight of about 6,000 to 20,000 g/mol, a high molecular weight amorphous polyester resin having a weight-average molecular weight of about 25,000 to 100,000 g/mol and a crystalline polyester resin having a weight-average molecular weight of about 10,000 to 25,000 g/mol, and the second binder resin includes the low molecular weight amorphous polyester resin and the high molecular weight amorphous polyester resin.

The crystalline polyester resin denotes a polyester resin having a distinct endothermic peak according to differential scanning calorimetry (DSC). The term 'distinct endothermic peak', refers to the endothermic peak of the crystalline polyester resin having a full width at half maximum of the endothermic peak of less than about 15° C. when measured at a temperature increase rate of about 10° C./minute by the DSC. The crystalline polyester resin is used to improve image gloss and low-temperature fixation of the toner. The amorphous polyester resin denotes a polyester resin that does not have a distinct endothermic peak according to the differential scanning calorimetry. For example, the amorphous polyester resin may be defined as a polyester resin exhibiting a glass transition appearing as a step in the baseline of the recorded DSC signal or having a full width at half maximum of the endothermic peak of more than about 15° C. when measured at a temperature increase rate of about 10° C./minute by the DSC. A melting temperature of the crystalline polyester resin may be in the range of about 60° C. to about 100° C., e.g., about 60° C. to 75° C. When the melting temperature of the crystalline polyester resin is in the range of about 60° C. to about 100° C., aggregation of toner particles is suppressed, preservability of a fixed image is improved, and low-temperature fixability may be improved. A glass transition temperature (Tg) of the amorphous polyester resin may be in the range of about 50° C. to about 80° C., e.g., about 50° C. to 70° C.

When the crystalline polyester is added to the amorphous polyester resin, high fixability is obtained due to sharp melting characteristics of the crystalline polyester, i.e., effect of rapid decrease in viscosity by rapid melting in a narrow temperature range. When a crystalline polyester having a relatively low melting point (above Tg of the amorphous polyester) in the range of maintaining durability and high preservability of the toner, is used, preparation of the toner having high fixability at low temperatures becomes possible. That is, a rapid reduction of the melting temperature is achieved at the fixing temperature by the sharp melting characteristics of the crystalline polyester while high Tg of the amorphous polyester is maintained by using a mixture of the crystalline polyester and the amorphous polyester, and low-temperature fixing characteristics may be secured as well as maintaining a heat storage ability. However, it is necessary to appropriately control miscibility between the crystalline and amorphous resins in order to effectively obtain such characteristics. In general, when two or more polyesters are melt-mixed, transesterification occurs between ester groups of two polyesters such that a mixture of two polymers will be changed into a copolymer type. Although the copolymer is initially a block copolymer type, it gradually changes into a random copolymer type as miscibility progresses. Therefore, crystallization is difficult to occur due to irregularity of a chemical structure of polyester chains, and a plasticizing effect, i.e., melting and glass transition temperatures of the mixture (or copolymer) move toward low temperatures, shows. Since durability and preservability of the toner may be adversely affected due to the above phenomenon, such a phenomenon is not desirable. The toner according to exemplary embodiments of the present disclosure is prepared by employing a method in which latex (emulsion) of each polyester resin is prepared in a particle size of about 100-300 nm, and thereafter, these particles are grown into particles having a particle size for the toner through aggregation and coalescence processes. Although the aggregation process is usually performed at Tg or less of the binder resin, the coalescence process is usually performed at Tg or the melting temperature or more of the binder resin. Since each polyester resin in the melted state is maintained for about 2-3 hours in the coalescence process, the miscibility inevitably occurs. Therefore, when crystallization becomes difficult to occur due to the performing of the miscibility, the sharp melting characteristics will disappear such that desired effect of low-temperature fixation may not be achieved. However, since the progression rate of the miscibility phenomenon depends on the miscibility between two polymers, molecular design of the polyester resins used for preparing the toner is important. In the toner according to exemplary embodiments of the present disclosure, in order to satisfactorily maintain high-temperature preservability, low-temperature fixability and high gloss of the final toner at the same time, it is necessary to strictly control the miscibility between the polyester binder resins and releasing agent among toner components by designing to have small changes in the melting temperature of the crystalline polyester and Tg of the amorphous polyester resin after preparation of the toner.

The polyester resin may be prepared by a reacting polyhydric alcohol with an aliphatic, a cycloaliphatic, or an aromatic polyvalent carboxylic acid, or alkyl esters thereof through direct esterification or transesterification.

The crystalline polyester resin may be obtained by reacting an aliphatic polyvalent carboxylic acid having a carbon number of 8 or more (excluding carbons of carboxylic group), e.g., a carbon number of 8 to 12, specifically a carbon number of 9 to 10 with a polyhydric alcohol having a carbon number of 8 or more, e.g., a carbon number of 8 to 12, specifically a carbon number of 9 to 10. For example, the crystalline polyester resin may be a polyester resin obtained by reacting 1,9-nonanediol with 1,10-decane dicarboxilic acid, or reacting 1,9-nonanediol with 1,12-dodecanedicarboxilic acid. By limiting the carbon number in the above ranges, the crystalline polyester resin having a melting temperature appropriate for the toner may be easily obtained, and it is also easy to have affinity with the amorphous polyester resin by increasing linearity of the resin chemical structure due to its being an aliphatic polyester resin.

The preparation of the polyester resin may be performed at the polymerization temperature of about 180° C. to about 230° C. Pressure in the reaction system may be reduced as needed, and the reaction may be accelerated by removing water or alcohol generated during condensation.

When a monomer is not dissolved or miscible at the reaction temperature, a solvent with a high boiling point may be added as a dissolution aid to dissolve the monomer. During the polycondensation, the dissolution aid solvent may be removed by distillation. When a monomer having poor miscibility exists in copolymerization, the monomer having poor miscibility and an acid or an alcohol scheduled for polycondensation therewith are condensed in advance and then, the polycondesation may further be performed with other monomers.

The polyvalent carboxylic acid, which is used to obtain the amorphous polyester resin, may include dicarboxylic acids, such as phthalic acid, isophthalic acid, terephthalic acid, tetrachlorophthalic acid, chlorophthalic acid, nitrophthalic acid, p-carboxyphenyl acetic acid, p-phenylene diacetic acid, m-phenylene diglycolic acid, p-phenylene diglycolic acid, o-phenylene diglycolic acid, dipheyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and/or cyclohexane dicarboxylic acid. Tricarboxylic acids and tetracarboxylic acids, such as trimellitic acid, pyromellitic acid, naphthalene tricarboxylic acid, naphthalene tetracarboxylic acid, pyrene tricarboxylic acid, and pyrene tetracarboxylic acid may also be used in addition to dicarboxylic acids. Derivatives of carboxylic acids, which are derived from the above carboxylic acids, such as an acid anhydride, an acid chloride, or an ester, etc. may also be used. Among these, isophthalic acid, terephthalic acid or a lower ester thereof, and cyclohexanedicarboxylic acid may specifically be mentioned. The lower ester denotes an ester of an aliphatic alcohol having a carbon number of 1 to 8.

Also, specific examples of polyhydric alcohol for obtaining the amorphous polyester resin may include aliphatic diols such as ethylene glycol, diethylene glycol, triethylene glycol, propylene glycol, butanediol, hexanediol, neopentyl glycol, glycerine, cycloaliphatic diols such as cyclohexanediol, cyclohexane dimethanol, hydrogenated bisphenol A, aromatic diols such as an ethylene oxide adduct of bisphenol A and a prophylene oxide adduct of bisphenol A. One or more of these polyhydric alcohols may be used. Among these polyhydric alcohols, aromatic diols and cycloaliphatic diols may specifically be mentioned, and the aromatic diols are more frequently used. Also, polyhydric alcohols having 3 or more hydroxyl groups (glycerine, trimethylolpropane, pentaerythritol) may be jointly used with diols in order to obtain a crosslinked structure or a branching structure, thereby attaining good fixability.

The amorphous polyester resin may be prepared by performing polycondensation reaction of polyhydric alcohol and polyvalent carboxylic acid according to a typical method. For example, the polyhydric alcohol and the polyvalent carboxylic acid are mixed in a reaction vessel equipped with a thermometer, a stirrer and a condenser with the addition of a catalyst if necessary.

The reaction progresses by heating the mixture at about 150-250° C. in an inert gas atmosphere (nitrogen gas, etc.) with continuous removal of low molecular weight compound, such as water, produced from the reaction to the outside of the reaction system. The reaction is stopped and cooled when a predetermined acid value is achieved, thereby obtaining the amorphous polyester resin.

A catalyst that may be used for the preparation of the crystalline or amorphous polyester resins includes compounds of alkali metals such as sodium and lithium, compounds of alkaline earth metals such as magnesium and calcium, compounds of metals such as zinc, manganese, antimony, titanium, tin, zirconium, and germanium, phosphorous acid-based compounds, phosphoric acid-based compounds, and amine compounds, etc. For example, organic metals such as dibutyltin dilaurate and dibutyltin oxide, or metal alkoxide such as tetrabutyl titanate may be used. From the view point of environmental impacts or safety, titanium-based or aluminum-based catalyst is desirable. The amount of catalyst addition may be about 0.01 wt % to about 1.00 wt % based on the total weight of raw materials.

The low molecular weight amorphous polyester resin may have a weight average molecular weight (Mw) of, for example, about 6,000 to about 20,000 g/mol, specifically, about 8,000 to about 13,000 g/mol, when measured for a tetrahydrofuran (THF)-soluble component by gel permeation chromatography (GPC). The high molecular weight amorphous polyester resin may have a weight average molecular weight (Mw) of, for example, about 25,000 to about 100,000 g/mol, specifically, about 30,000 to about 50,000 g/mol, when measured for a tetrahydrofuran (THF)-soluble component by gel permeation chromatography (GPC). The crystalline polyester resin may have a weight average molecular weight (Mw) of, for example, about 8,000 to about 30,000 g/mol, specifically, about 10,000 to about 25,000 g/mol, when measured for a tetrahydrofuran (THF)-soluble component by gel permeation chromatography (GPC). When the weight-average molecular weights are within the above range, the low-temperature fixability and anti-offset property of the toner may be improved, and the strength of an image fixed on a paper is increased since the deterioration of the strength of resin is suppressed. In addition, the storage characteristics, such as anti-blocking characteristics, of the toner may be improved since a decrease in the glass transition temperature of the toner may be prevented.

The toner exhibits rheological behavior satisfying the following equations (1), (2) and (3) according to temperature changes:

$$0.01<S\kappa<0.04, 0.05<S\lambda<0.2, \text{ and } 2<S\lambda/S\kappa<20, \quad (1)$$

where, $S\kappa=[\log G'(40° C.)-\log G'(50° C.)]/10$ and $S\lambda=[\log G'(50° C.)-\log G'(60° C.)]/10$, $$0.1<S\sigma<0.2 \text{ and } 0.06<S\tau<0.1, \quad (2)$$

where, $S\sigma=[\log G'(60° C.)-\log G'(70° C.)]/10$ and $S\tau=[\log G'(70° C.)-\log G'(80° C.)]/10$, and $$70° C.<Tp<80° C., 1\times10^5 \text{ Pa}<G'p<5\times10^5 \text{ Pa}, \quad (3)$$

Here, Tp denotes a temperature satisfying the condition (a p condition) of $S\sigma/S\tau>1$, G'p denotes a shear storage modulus at a temperature satisfying the p condition, and G'(temperature) denotes a shear storage modulus (unit: Pa) measured under conditions including a measurement frequency of about 6.28 rad/s, a heating rate of about 2.0° C./min, an initial strain of about 0.3% and a temperature indicated in a parenthesis. In the present disclosure, the shear storage modulus of the toner is measured at the temperature range of about 40-180° C. under the above conditions. For example, G'(40° C.) and G'(50° C.) represent the shear storage modulus (Pa) at 40° C. and 50° C., respectively, which are obtained from the measurement results of dynamic viscoelasticity of the toner by using a two circular disc-type rheometer (e.g., TA ARES) according to the conditions of the measurement frequency of about 6.28 rad/s, the heating rate of about 2.0° C./min, and the initial strain of about 0.3%. The strains during the measurement are automatically controlled by the rheometer.

Properties of the polymerized toner using the polyester binder resin are determined in large part by thermal and physicochemical properties and a mixing ratio of the amorphous and crystalline polyester resins, an ionic cross-linking density due to process control conditions (e.g., used amounts and types of the binder resin, coagulant, and colorant, etc.) during aggregation/coalescence processes, and by rheological behaviors influenced by the above factors. For example, when the mixing ratio of the crystalline polyester is increased, low-temperature fixability may be achieved due to a rapid decrease in the modulus. However, an electric charge density tends to deteriorate due to an increase in a dielectric loss factor and storage ability deteriorates due to a decrease in fluidity caused by a surface protrusion of the crystalline polyester. The reason for the deterioration is that the crystalline polyester resin tends to absorb moisture because it has a molecular structure including many hydrophilic groups such as a carboxyl group, a hydroxyl group, and an ester bond. On the other hand, these hydrophilic groups are also a factor helping to achieve low-temperature fixability. Therefore, in preparation of the toner having the above desirable characteristics, it is important to design desirable rheological behavior by overall control of the related factors (e.g., solubility parameters, acid value, molecular weight and molecular weight distribution, glass transition temperature) affecting low-temperature fixability and heat storage ability through molecular structure design of the polyester resin.

Particularly, in preparation of the present toner, rheological behaviors of the equations (1), (2) and (3) may be achieved by using a combination of the low molecular weight and high molecular weight of the amorphous polyester resins and crystalline polyester resin and through selection of a releasing agent and control of aggregation-coalescence process conditions. Accordingly, a certain level of low-temperature fixability, charge stability, fluidity, heat storage ability, wide color gamut and gloss may be achieved. Therefore, excellent image characteristics may be achieved, a wide fixing region may be secured, and a toner having improved durability may be obtained. When the rheological behaviors of the equations (1), (2) and (3) are satisfied, a slope of the shear storage modulus of the toner is rapidly decreased during fixation process. As a result, low-temperature fixation becomes possible with a small amount of heat in a short period of time (high speed) by sufficiently performing fusion of the toner. Therefore, a stable image may be obtained more easily, and low-temperature high-speed fixation may be possible.

The storage moduli at 100° C. or less, i.e., G'(40° C.), G'(50° C.), G'(60° C.), G'(70° C.), and G'(80° C.), are affected by glass transition temperatures (Tg) and melting temperatures (Tm) of polyester latex and releasing agent, i.e., wax, and types of coagulant and colorant, etc. The storage moduli at 100° C. or more, i.e., G'(120° C.) and G'(140° C.), may be greatly affected by internal dispersibility, molecular weight, degree of cross-linking, particle size distribution of the toner rather than thermal properties of polyester latex and wax. Therefore, values of G'(120° C.) and G'(140° C.) may be determined overall by properties of raw materials, such as polyester latex, colorant, releasing agent, and coagulant, etc., used during the preparation of the toner, and by physical properties of the prepared toner.

For example, the value of log G'(60° C.) of the toner may be in the range of about $0.7\times10^1$ to about $0.90\times10^1$, about $0.73\times10^1$ to about $0.87\times10^1$, and about $0.75\times10^1$ to about $0.85\times10^1$. If the value of log G'(60° C.) satisfies the range, the modulus of the toner is appropriately maintained at 60° C. which is an initial heating temperature for a fixing process of the toner. Therefore, transfer defects seldom occur because deformation of the toner does not occur in a transferring process of the toner, developability is not sensitive to environment because excellent heat storage ability is exhibited, and durability in a printer may be expected.

The toner may also exhibit rheological behavior further satisfying the condition of the following equation (6) according to temperature change:

$$0<[\log G'(120^\circ\text{ C.})-\log G'(140^\circ\text{ C.})]/20<0.05. \quad (6)$$

If this value satisfies the above ranges, the slope of the storage modulus according to temperature is gradually maintained at a high temperature of about 120° C. to about 140° C. Therefore, offset at high temperatures may be prevented during the fixation of the toner, and as a result, a deterioration in gloss uniformity seldom occurs so that a high quality image, high gloss and excellent color reproducibility may be obtained.

In the toner, the binder resins (including the first and second binder resins) have a mixing ratio satisfying the conditions of the following equation (4), and the high molecular weight amorphous polyester resin and the low molecular weight amorphous polyester resin may have a molecular weight difference satisfying the condition of the following equation (5):

$$1<[\alpha_L]/[\alpha_H]<4 \text{ and } 2<([\alpha_L]+[\alpha_H])/[\beta]<30, \text{ and} \quad (4)$$

$$0.3<(\log M_H-\log M_L)<1, \quad (5)$$

Here, $[\alpha_L]$ and $[\alpha_H]$ denote weights of the low molecular weight amorphous polyester resin and the high molecular weight amorphous polyester resin in the toner, respectively, $[\beta]$ denotes the weight of the crystalline polyester resin in the toner, and $M_H$ and $M_L$ are weight-average molecular weights of the high molecular weight amorphous polyester resin and the low molecular weight amorphous polyester resin, respectively. In the range satisfying the equation (4), the first binder resin of the core layer may include about 70 wt % or more of the amorphous polyester resin including the low and high molecular weight amorphous polyester resins and about 30 wt % or less of the crystalline polyester resin. A mixing ratio of the low molecular weight amorphous polyester resin versus the high molecular weight amorphous polyester resin is not particularly limited, and may be changed in the weight ratio range of about 5:95 to about 95:5. The second binder resin is composed of the amorphous polyester resin including the low and high molecular weight amorphous polyester resins.

When the equations (1), (2) and (3) are not satisfied, lower-temperature fixability, charge stability, fluidity, storage stability of the toner are decreased. When the equations (4) and (5) are not satisfied, durability of the toner may be decreased.

The weight-average molecular weight of the toner according to the present disclosure may be about 20,000 g/mol to about 60,000 g/mol, for example, about 25,000 g/mol to about 55,000 g/mol. This molecular weight is a value obtained from molecular measurement by the GPC method on a tetrahydrofuran (THF) soluble fraction. When the weight-average molecular weight is too small, durability may be decreased. When the weight-average molecular weight is too large, low-temperature fixation of the toner is difficult to achieve, and image defects through hot offset or gloss reduction due to surface roughness increase are generated by an increase in melt viscosity. Also, a reduction in releasability may be generated in an oil-less fixing system.

Since the releasing agent increases low-temperature fixability, excellent final image durability and abrasion resistance of the toner, types and content of the releasing agent play an important role in determining toner characteristics. The releasing agent may be a natural wax or a synthetic wax. The type of the releasing agent is not limited thereto, but may be selected from the group consisting of polyethylene-based wax, polypropylene-based wax, silicone wax, paraffin-based wax, ester-based wax, carnauba wax and a metallocene wax. A melting temperature of the releasing agent may be in the range of about 60° C. to about 100° C., for example, about 70° C. to about 90° C. The releasing agents physically adhere to the toner particles, but do not covalently bond with the toner particles.

The content of the releasing agent may, for example, be in the range of about 1 part by weight to about 20 parts by weight, about 2 parts by weight to about 16 parts by weight, or about 3 parts by weight to about 12 parts by weight based on 100 parts by weight of the toner. When the content of the releasing agent is about 1 part by weight or more, low-temperature fixability is good and the fixing temperature range is sufficiently secured. When the content of the releasing agent is about 20 parts by weight or less, storage ability and economy may be improved.

The releasing agent may be an ester-based wax including an ester group. A specific example thereof may include: (1) a mixture of ester-based wax and non-ester-based wax; and (2) an ester group-containing wax prepared by adding an ester group to a non-ester based wax. Since the ester group has high affinity for the polyester latex components of the toner, the wax may be uniformly distributed throughout the toner particles to effectively exhibit wax effects. The non-ester-based wax components may suppress excessive plasticization that may occur when only the ester-based wax is present, due to a releasing effect of the latex. As a result, the mixture of ester-based wax and non-ester-based wax may maintain good developability of the toner for a long period of time.

Examples of the ester-based wax may include esters of fatty acids with a carbon number of about 15-30 and a mono- to pentavalent aliphatic alcohol, such as behenyl behenate, stearyl stearate, pentaerythritol stearate, glyceryl montanate, etc. The aliphatic alcohol component constituting the ester may be monovalent aliphatic alcohol with a carbon number of about 10-30 or polyhydric alcohol with a carbon number of about 3-10.

The non-ester-based wax may include a polyethylene-based wax, polypropylene-based wax, silicone wax, and a paraffin-based wax, etc.

Examples of the ester group-containing wax may include a mixture of a paraffin-based wax and an ester-based wax; and an ester group-containing paraffin-based wax. A specific example thereof may include P-212, P-280, P-318, P-319, and P-419 (manufactured by CHUKYO YUSHI CO., LTD.).

When the releasing agent is a mixture of paraffin-based wax and ester-based wax, the amount of the ester-based wax may be, for example, in the range of about 1 wt % to about 50 wt %, for example, about 5 wt % to about 50 wt %, or about 10 wt % to about 50 wt %, or about 15 wt % to about 50 wt % based on the total weight of the mixture of paraffin-based wax and ester-based wax. When the amount of the ester-based wax is about 1 wt % or more, miscibility with latex is sufficiently maintained, and when the amount of the ester-based wax is about 50 wt % or less, plasticizing characteristics of the toner are appropriately controlled and the toner retains developability for a long period of time. In the present toner, the releasing agent may be selected such that a solubility parameter (SP) value of the binder resin has a difference of about 2 or more when compared with a SP value of the paraffin-based wax and a SP value of the ester-based wax. By selecting a combination of the binder resin and the releasing agent having such SP values, exposure of the releasing agent from the surface of the toner may be suppressed. Meanwhile, if the difference between the SP values is small, a plasticization phenomenon may occur between the binder resin and the releasing agent.

The toner of the present disclosure may further include a coagulant including silicon (Si) and iron (Fe). When silicon intensity and iron intensity determined by X-ray fluorescence (XRF) measurements are denoted as [Si] and [Fe], an [Si]/[Fe] ratio of the toner may satisfy the following condition: $5\times10^{-4}\leq[Si]/[Fe]\leq5.0\times10^{-2}$. For example, the [Si]/[Fe], ratio of the silicon intensity [Si] versus the iron intensity [Fe], may be in the range of about $5.0\times10^{-4}$ to about $5.0\times10^{-2}$, specifically about $8.0\times10^{-4}$ to about $3.0\times10^{-2}$ or about $1.0\times10^{-3}$ to about $1.0\times10^{-2}$. When the [Si]/[Fe] ratio is too small, fluidity of the toner decreases because the amount of a silica external additive becomes too small, and when the ratio is too large, the inside of a printer may be contaminated because the amount of the silica external additive becomes too large.

The iron intensity [Fe] corresponds to an iron content originated from the coagulant used for aggregating latex, colorant, and releasing agent during the preparation of the toner. The iron intensity [Fe] may affect ease of aggregation, particle size distribution, and size of aggregated toner particles which correspond to a precursor of the final toner.

The silicon intensity [Si] is a value corresponding to silicon content originated from the coagulant used during the preparation of the toner or from the silica external additive added to obtain fluidity of the toner. According to the silicon intensity [Si], effects of elements such as the iron, and the fluidity of the toner may be affected.

A volume average diameter of a toner for developing an electrostatic charge image according to an exemplary embodiment of the present disclosure may be in the range of about 3 μm to about 9.5 μm. For example, the diameter may be in the range of about 4 μm to about 8.5 μm, and about 4.5 μm to about 7.5 μm. Generally, although it is advantageous for obtaining high resolution and high quality for a toner particle to be smaller, it is disadvantageous at the same time in terms of transfer speed and ease of being cleaned. Therefore, it is important to have an appropriate diameter. The volume average diameter of the toner may be measured by using an electrical resistance method. When the volume average diameter of the toner is about 3.0 μm or more, photoreceptor cleaning is easy, production yield is improved, a scattering of toner particles may be prevented, and a high resolution and high quality image may be obtained. When the volume average diameter of the toner is about 9.5 μm or less, charging is uniform, fixability of the toner is improved, and it may be easier for a doctor blade to control a toner layer.

Average circularity of the toner particles for developing an electrostatic charge image according to an exemplary embodiment of the present disclosure may be in the range of about 0.940 to about 0.985. For example, the average circularity may be in the range of about 0.945 to about 0.975, or about 0.950 to about 0.970. The average circularity of the toner particles may be calculated by a method that will be described below. A value of circularity is in the range of 0 and 1, and the toner particle becomes more spherically shaped as the value of circularity approaches 1. When the average circularity of the toner particles is about 0.940 or more, toner consumption may be reduced because height of the image developed on a transfer member is appropriate, and sufficient coverage on the image developed on the transfer member may be obtained because voids between the toners are not extensively enlarged. When the average circularity of the toner particles is about 0.985 or less, excessive supply of the toner on a developing sleeve is prevented so that a problem of causing contamination by non-uniform coating on the sleeve with the toner may be improved.

A volume average particle size distribution index GSDv or a number average particle size distribution index GSDp as defined below may be used as an index of toner particle size distribution. A measurement method thereof will be described below. GSDv and GSDp values of toner particles for developing an electrostatic charge image according to an exemplary embodiment of the present disclosure may be about 1.25 or less and about 1.30 or less, respectively. The GSDv value may be about 1.25 or less, and for example, may be in the range of about 1.10 to about 1.25. The GSDp value may be about 1.30 or less, and for example, may be in the range of about 1.15 to about 1.30. If the values of the GSDv and GSDp satisfy the above ranges, a uniform particle diameter of the toner may be obtained.

The core layer of the toner particles for developing an electrostatic charge image according to an exemplary embodiment of the present disclosure may include a colorant. The colorant includes black colorant, cyan colorant, magenta colorant, and yellow colorant, etc.

The black colorant may be carbon black or aniline black.

The yellow colorant may be a condensation-type nitrogen compound, an isoindolinone compound, an anthraquine compound, an azo metal complex, or an allyl imide compound. In particular, C.I. pigment yellow 12, 13, 14, 17, 62, 74, 83, 93, 94, 95, 109, 110, 111, 128, 129, 147, 168, 180, or the like may be included.

The magenta colorant may be a condensation-type nitrogen compound, an anthraquine compound, a quinacridone compound, a basic dye lake compound, a naphthol compound, a benzo imidazole compound, a thioindigo compound or a perylene compound. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be included.

A copper phthalocyanine compound and derivatives thereof, or an anthraquine compound may be used as the cyan colorant. In particular, C.I. pigment blue 1, 7, 15, 15:1, 15:2, 15:3, 15:4, 60, 62, 66, or the like may be included.

Such colorants may be used alone or by combining to form a mixture of two or more, and are selected by considering color, chroma, luminosity, weather resistance, dispersibility in the toner, etc.

Content of the colorant is sufficient if the amount thereof is sufficient to dye the toner. For example, the content of the colorant may be in the range of about 0.5 parts by weight to about 15 parts by weight, about 1 part by weight to about 12 parts by weight, or about 2 parts by weight to about 10 parts by weight based on 100 parts by weight of the toner. When the content of the colorant is about 0.5 parts by weight or more based on 100 parts by weight of the toner, sufficient coloring effect may be obtained. When the content of the colorant is about 15 parts by weight or less, a sufficient tribo-charge quantity may be provided without significantly increasing the manufacturing cost of the toner.

In the toner particles for developing an electrostatic charge image according to an exemplary embodiment of the present disclosure, a shell layer is coated on the core layer. The shell layer is formed of the second binder resin including the amorphous polyester resins. The shell layer increases charge stability as well as durability by preventing crystalline materials such as a crystalline polyester and a releasing agent included in the core layer, which exert adverse effects on charging characteristics, from being exposed to the surface.

The toner particles for developing an electrostatic charge image according to an exemplary embodiment of the present disclosure may have narrow particle size distribution in which fine particles with the diameter of less than about 3 μm are included less than about 3 wt %, and coarse particles with the diameter of about 16 μm or more are included less than about 0.5 wt %.

According to another aspect of the present disclosure, provided is a method of preparing the polymerization toner with a core-shell structure, which may stably form high-quality images for a long period of time due to an excellent color gamut, low-temperature fixability, charge stability and heat storage ability as well as having durability against the environment, by using an emulsion aggregation (EA) method favorable to preparation of small particle size and precise control of particle size distribution in addition to controlling of rheological behavior through combination of the low and high molecular weight amorphous polyester resins and the crystalline polyester resin, control of mixing ratio thereof, and selection of types of a coagulant and a releasing agent, etc.

Specifically, the method for preparing a toner for developing an electrostatic charge image includes: preparing a mixture by mixing a first binder resin latex, a colorant, and a releasing agent, wherein the first binder resin includes a low molecular weight amorphous polyester resin having the weight-average molecular weight of about 6,000 to 20,000 g/mol, a high molecular weight amorphous polyester resin having the weight-average molecular weight of about 25,000 to 100,000 g/mol, and a crystalline polyester resin having the weight-average molecular weight of about 8,000 to 30,000 g/mol; adding a coagulant into the mixture to form core particles including the first binder resin, the colorant and the releasing agent; forming shell layers on the core particles by adding a second binder resin latex in a dispersion of the core particles and adhering the second binder resin on surfaces of the core particles to form fine particles including the core and shell layers, wherein the second binder resin includes the low and high molecular weight amorphous polyester resins; aggregating the fine particles in a temperature range having shear storage moduli (G') of the first and second binder resins ranging from about $1.0\times10^8$ Pa to about $1.0\times10^9$ Pa; stopping the aggregation reaction when the average particle size of the fine particles reaches a range of about 70% to about 100% of an average target particle size of final toner particles; coalescing the aggregated fine particles in a temperature range having shear storage moduli (G') of the first and second binder resins ranging from about $1.0\times10^4$ Pa to about $1.0\times10^7$ Pa; and obtaining a final toner by further aggregating and coalescing the fine particles in a temperature range having shear storage moduli (G') of the first and second binder resins ranging from about $1.0\times10^4$ Pa to about $1.0\times10^9$ Pa, wherein the low molecular weight amorphous polyester resin, the high molecular weight amorphous polyester resin and the crystalline polyester resin satisfy the following mixing ratio when forming the core layer and the shell layer by using the first and second binder resin latexes:

$$1<[\alpha_L]/[\alpha_H]<4 \text{ and } 2<([\alpha_L]+[\alpha_H])/[\beta]<30.$$

Here, $[\alpha_L]/[\alpha_H]$, and $[\beta]$ are the same as defined above.

First, the forming of the mixture is described. The first binder resin latex including the low and high molecular weight amorphous polyester resins and the crystalline polyester resin is prepared. The low molecular weight amorphous polyester resin latex, the high molecular weight amorphous polyester resin latex and the crystalline polyester resin latex may be used as the first binder resin latex through separate preparation, respectively. Alternatively, the first binder resin latex may be used by preparing a mixture in latex form including at least two or more of the low molecular weight amorphous polyester resin, the high molecular weight amorphous polyester resin and the crystalline polyester resin. The amorphous polyester resin and the crystalline polyester resin may be prepared as latex using a phase inversion emulsification method. For this purpose, a polyester organic solution is first prepared by dissolving the polyester resin in an organic solvent. The organic solvent may be a solvent known in the art, but typically, a ketone solvent such as acetone and methyl ethyl ketone, an aliphatic alcohol solvent such as methanol, ethanol, and isopropanol, or combinations thereof may be used. Subsequently, NaOH, KOH, or ammonium hydroxide aqueous solution are added into the organic solution and stirred. At this time, the added amount of the basic compound is determined so that it will react with the amount of carboxylic groups present in the polyester resin which may be calculated from an acid value of the polyester resin in an equivalent weight basis. A large amount of water is added into the polyester resin organic solution to perform phase inversion emulsification which converts the organic solution into an oil-in-water emulsion. At this time, a surfactant may be further included selectively. The polyester resin latex may be obtained by removing the organic solvent from the obtained emulsion by using a method such as vacuum distillation, etc. As a result, for example, resin latex (emulsion) including polyester resin particles having an average particle diameter of about 1 μm or less, about 100 to about 300 nm, and about 150 to about 250 nm is obtained.

Solid content of the resin latex is not particularly limited, but this may be in the range of about 5 wt % to about 40 wt %, for example, about 15 wt % to about 30 wt %. The first binder resin latex functioning as a binder resin of the core layer is prepared by mixing the amorphous polyester resin latex and crystalline polyester resin latex thus prepared. Alternatively, the amorphous polyester resin latex and the crystalline polyester resin latex are not mixed in advance and may be individually mixed as a portion of the first binder resin latex when mixing with a colorant dispersion and a releasing agent dispersion, etc.

Other polymers, which are obtainable by polymerizing one or more monomers, may be included in the polyester latex if necessary. In this case, the monomer may be one or more monomers selected from the group consisting of styrene-based monomers such as styrene, vinyl toluene and α-methyl styrene; acrylic acid or methacrylic acid; derivatives of (meth)acrylic acid such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylamide and methacryl amide; acrylonitrile, methacrylonitrile; ethylenically unsaturated mono-olefins such as ethylene, propylene and butylenes; halogenized vinyl monomers such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

The polyester latex may further include a charge control agent. The charge control agent used herein may include a negative charge-type charge control agent or a positive charge-type charge control agent. The negative charge-type charge control agent may include an organic metal complex or a chelate compound such as azo dyes containing chromium or a mono azo metal complex; a salicylic acid compound containing metal such as chromium, iron and zinc; or an organic metal complex of aromatic hydroxycarboxylic acid or aromatic dicarboxylic acid. Moreover, any known charge control agent may be used without limitation. The positive charge-type charge control agent may include nigrosine, nigrosine modified with a fatty acid metal salt and an onium salt including a quaternary ammonium salt such as tributylbenzylammonium 1-hydroxy-4-naphthosulfonate and tetrabutylammonium tetrafluoro borate, etc. Since the charge control agent stably supports the toner on a developing roller by electrostatic force, charging may be performed stably and quickly using the charge control agent.

The prepared first binder resin latex (polyester latex) may be mixed with the colorant dispersion and the releasing agent dispersion to form a mixture.

The colorant dispersion may be prepared by homogeneously dispersing a composition including colorants such as black, cyan, magenta and yellow and an emulsifier using an ultrasonic homogenizer, micro fluidizer and the like. Types and contents of colorants that may be used are as described above. Such colorants may be used alone or by combining to form a mixture of two or more, and are selected by considering color, chroma, luminosity, weather resistance, dispersibility in the toner, etc. Any emulsifier that is known in the art may be used as an emulsifier used when preparing the colorant dispersion. For example, an anionic reactive emulsifier, a non-ionic reactive emulsifier or a mixture thereof may be used. A specific example of the anionic reactive emulsifier may include HS-10 (Dai-ichi Kogyo, Co., Ltd.) and Dowfax 2A1 (Rhodia Inc.), etc. A specific example of the non-ionic reactive emulsifier may include RN-10 (Dai-ichi Kogyo, Co., Ltd.).

The releasing agent dispersion includes a releasing agent, water, and an emulsifier. Types and contents of emulsifiers that may be used are as described above. The emulsifier included in the releasing agent dispersion may be an emulsifier that is known in the art like the emulsifier used in the colorant dispersion.

The mixture is prepared by mixing the first binder resin latex, colorant dispersion and releasing agent dispersion, which are obtained as described above. An apparatus such as homo mixer and homogenizer may be used during preparation of the mixture.

Subsequently, the core particles including the first binder resin, colorant and releasing agent are formed by adding the coagulant into the mixture. Specifically, after controlling the pH of the mixture in the range of about 0.1 to about 4.0, the coagulant is added at temperatures equal to or less than the melting temperature of the crystalline polyester resin and equal to or less than Tg of the amorphous polyester, for example, about 25° C. to about 70° C., specifically about 35° C. to about 60° C., and primary aggregated toner is generated in terms of a shear-induced aggregation mechanism caused by the homogenizer, etc.

Subsequently, by adding the second binder resin latex including the low and high molecular weight amorphous polyester resins into the dispersion having the core particles, i.e., primary aggregated toner, the second binder resin is disposed on, for example, attached on the surfaces of the core particles such that the shell layer is formed on the surfaces of the core particles. After controlling pH of the system in the range of about 6 to 9, secondary toner particles having the size of about 3-9.5 μm, and more specifically about 5-7 μm, are prepared through a coalescence process at a temperature of about 85-100° C. (corresponding to a temperature of about 20-50° C. higher than Tg of the amorphous polyester) when the particle size has been constantly maintained for a certain period of time. After the coalescence process, the temperature of the system is decreased to equal to or less than Tg of the polyester, and thereafter, aggregation and coalescence processes may be further performed.

The metallic salts containing silicon (Si) and iron (Fe) may be used as a coagulant. When the metallic salts containing Si and Fe are used, the size of the primary aggregated toner particles will be increased by increased ionic strength and collisions between particles. For example, the metallic salts containing Si and Fe may include "Polysilicato-Iron", and particularly, may use PSI-025, PSI-050, PSI-085, PSI-100, PSI-200, and PSI-300 (product names, SUIDO KIKO KAISHA LTD.). PSI is an abbreviation of "Polysilicato-Iron". Physical properties and compositions thereof are listed in Table 1 below. The metal salts containing Si and Fe exhibit a strong aggregation force even at a lower temperature and a smaller amount of coagulant may be used as compared to the coagulants used in a typical emulsion-aggregation (EA) method. Above all, since these metal salts use iron and silica as main components, effects of residual aluminum on the environment and the human body, which is limitation of typical trivalent aluminum polymer coagulants, may be minimized.

TABLE 1

| Type | | PSI-025 | PSI-050 | PSI-085 | PSI-100 | PSI-200 | PSI-300 |
|---|---|---|---|---|---|---|---|
| Si/Fe mole ratio | | 0.25 | 0.5 | 0.85 | 1 | 2 | 3 |
| Main component concentration | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or more | | | | | |
| Average molecular weight (g/mol) | | about 500,000 | | | | | |
| Appearance | | Yellowish brown transparent liquid | | | | | |

For example, content of the coagulant may be in the range of about 0.1 to about 10 parts by weight, about 0.5 to about 8 parts by weight, about 1 to about 6 parts by weight based on 100 parts by weight of the first binder latex. At this time, aggregation efficiency is improved when the content of the coagulant is about 0.1 parts by weight or more, and particle size distribution may be improved by preventing a decrease in chargeability of the toner when the content of the coagulant is about 10 parts by weight or less.

Meanwhile, a third binder resin latex may be additionally coated on the secondary aggregated toner, and the third binder resin latex uses the polyester resin alone or may use a mixture of the polyester resin and a polymer prepared by polymerizing one or more monomer mentioned above.

Durability of the toner may be improved by forming the shell layer, and limitations in storage ability of the toner in terms of shipping and handling may be resolved. Toner particles are separated by filtering the secondary aggregated toner or the tertiary aggregated toner obtained as the above, and dried. When an external additive is added on the dried toner, final dry toner is obtained by adjusting a charge quantity, etc. The external additive that may be used includes silica, titania, and alumina, etc. For example, the added amount of the external additive may be in the range of about 1.5 to about 7 parts by weight, and about 2 to about 5 parts by weight based on 100 parts by weight of the toner having no external additive. When the added amount of the external additive is about 1.5 parts by weight or more, charge quantity becomes stable by preventing a caking phenomenon in which the particles are adhered to one another to form cake due to the cohesive force between the toner particles. When the added amount of the external additive is about 7 parts by weight or less, contamination of a roller due to an excessive amount of the external additive component may be prevented.

According to another aspect of the present disclosure, there is provided a method of forming an image including adhering a toner to a surface of an image carrier on which an electrostatic latent image is formed to form a visible image and transferring the visible image to an image receiving member, wherein the toner is for developing an electrostatic charge image according to an aspect of the present disclosure.

An electrophotographic image forming process includes a series of steps including the steps of charging, image-wise exposure to light, developing, transfer, fixation, cleaning and erasure to form an image on an image receiving member.

In the charging step, a surface of an image carrier such as photoreceptor is charged with one of desired polarities, i.e., negative or positive charge, by a corona charging device or a charge roller. In the exposing step, an optical system, conventionally a laser scanner or an array of diodes, forms a latent image by selectively discharging the charged surface of the image carrier in an imagewise manner corresponding to a target image formed on a final image receiving member. Electromagnetic radiation, originated from the laser scanner or array of diodes and referred to as "light", may include infrared irradiation, visible light irradiation, or ultraviolet irradiation.

In the developing step, toner particles with appropriate polarity generally contact the latent image on the image carrier, and conventionally, an electrically-biased developer having identical potential polarity to the toner polarity is used. The toner particles move to the image carrier and selectively adhere to the latent image by electrostatic force to form a toner image on the image carrier.

In the transferring step, the toner image is transferred to the final image receiving member from the image carrier. An intermediate transferring member which receives the toner image from the image carrier and subsequently transfers it to the final image receiving member is sometimes used.

In the fixing step, the toner particles are softened or melted by heating the toner image on the final image receiving member, thereby fixing the toner image to the final image receiving member. Another fixing method is to fix the toner on the final image receiving member under high pressure with or without application of heat.

In the cleaning step, residual toner remaining on the image carrier is removed.

Finally, in the erasure step, charges of the image carrier are exposed to light of a specific wavelength band and are reduced to a substantially uniform low value. Therefore, a residue of the latent image is removed and the image carrier is prepared for a next image forming cycle.

The present disclosure also provides a toner supply device including: a toner tank storing a toner; a supplying part protruding toward an inner side of the toner tank and supplying the stored toner to the outside; and a toner stirring member rotatably installed inside the toner tank and configured to stir the toner in almost an entire inner space of the toner tank including a top surface of the supplying part, wherein the toner is for developing an electrostatic charge image according to the another aspect of the present disclosure.

FIG. 1 is a perspective view illustrating a toner supply device according to an exemplary embodiment of the present disclosure. Referring to FIG. 1, the toner supplying apparatus 100 includes a toner tank 101, a supplying part 103, a toner conveying member 105, and a toner stirring member 110.

The toner tank 101 stores a predetermined amount of toner and is generally formed in a hollow cylindrical shape.

The supplying part 103 is installed at an inner lower part of the toner tank 101 and discharges the toner stored in the toner tank 101 to the outside of the toner tank 101. That is, the supplying part 103 may protrude from a bottom of the toner tank 101 to the inside of the toner tank 101 in a pillar shape having a semi-circular section. The supplying part 103 includes a toner outlet (not shown) to discharge the toner to an outer surface thereof.

The toner conveying member 105 is installed at a side of the supplying part 103 at the inner lower part of the inside of the toner tank 101. The toner conveying member 105 is formed in a coil spring shape. Since an end of the toner conveying member 105 extends to an inner side of the supplying part 103, the toner in the toner tank 101 is conveyed in the direction of arrow A to the inner side of the supplying part 103 when the toner conveying member 105 rotates. The toner conveyed by the toner conveying member 105 is discharged to the outside through the toner outlet.

The toner stirring member 110 is rotatably installed inside the toner tank 101 and forces the toner in the toner tank 101 to move in a radial direction. That is, when the toner stirring member 110 rotates at a middle of the toner tank 101, the toner in the toner tank 101 is stirred to prevent the toner from solidifying. Then, the toner moves down to the bottom of the toner tank 101 by its own weight. The toner stirring member 110 includes a rotation shaft 112 and a toner stirring film 120. The rotation shaft 112 is rotatably installed at the middle of the toner tank 101 and has a driving gear (not shown) coaxially installed at an end of the rotation shaft 112 protruding toward a side of the toner tank 101. Therefore, the driving gear and the rotation shaft 112 may rotate as one unit. Also, the rotation shaft 112 may have a wing plate 114 to help fix the toner stirring film 120 to the rotation shaft 112. In general, the wing plate 114 may be symmetrically formed about the rotation shaft 112.

The toner stirring film 120 has a width corresponding to the inner length of the toner tank 101, and may be elastically deformed along a protrusion at an inner side of the toner tank 101, i.e., the supplying part 103. Portions of the toner stirring film 120 may be cut off from an end of the toner stirring film 120 toward the rotation shaft 112 to form a first stirring part 121 and a second stirring part 122.

Figure 2:
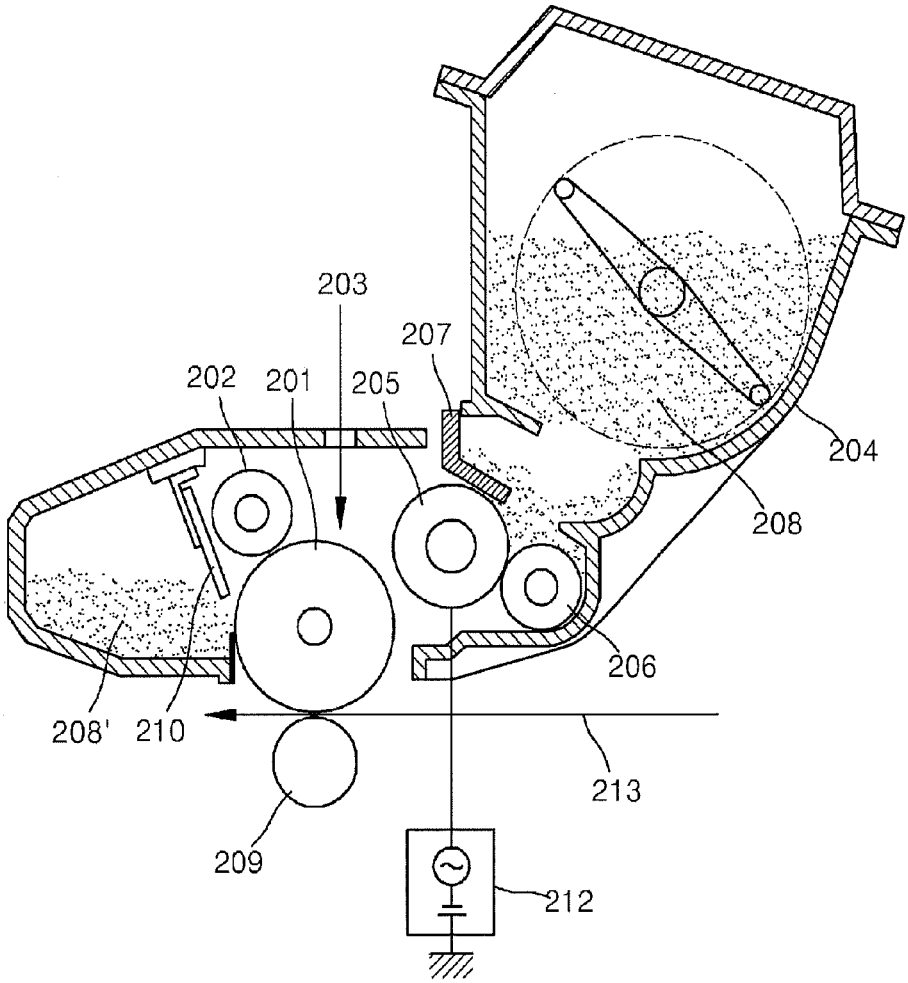
FIG. 2 is an example of an apparatus for forming an image containing a toner prepared according to an exemplary embodiment of the present disclosure.

FIG. 2 is a view illustrating an example of a non-contact development type image forming apparatus including a toner according to another aspect of the present disclosure, and an operating principle thereof will be described below.

A nonmagnetic one-component developer 208 in a developing device 204, i.e., a toner 208, is supplied on a developing roller 205 by a supplying roller 206 formed of an elastic material, such as polyurethane foam or sponge, etc. The developer 208 supplied on the developing roller 205 reaches a contact portion between a developer controlling blade 207 and the developing roller 205 according to the rotation of the developing roller 205. The developer controlling blade 207 may be formed of an elastic material, such as metal or rubber, etc. When the developer 208 passes through the contact portion between the developer controlling blade 207 and the developing roller 205, the developer 208 is controlled and formed into a thin layer having uniform thickness, and may be sufficiently charged. The thin-layered developer 208 is transferred to a development region in which the toner 208 is developed on a latent image of a photoreceptor 201, which is an example of an image carrier, by the developing roller 205. At this time, the latent image is formed by scanning light 203 to the photoreceptor 201.

The developing roller 205 is separated from the photoreceptor 201 by a predetermined distance and faces the photoreceptor 201. The developing roller 205 rotates in a counterclockwise direction, and the photoreceptor 201 rotates in a clockwise direction.

The toner 208, which has been transferred to the development region of the photoreceptor 201, develops the latent image formed on the photoreceptor 201 by an electric force generated by a potential difference between a direct current (DC) biased alternating current (AC) voltage applied a power source 212 to the developing roller 205 and a potential of the latent image on the photoreceptor 201 charged by a charging device 202. As a result, the toner 208 may form a toner image.

The toner 208 developed on the photoreceptor 201 reaches a position of a transfer device 209 according to the rotation direction of the photoreceptor 201. An image is formed by transferring the toner 208 developed on the photoreceptor to a printing paper 213, i.e., an image receiving member, by corona discharging or the transfer device 209 having a roller shape to which high voltage with a polarity opposite to the toner 208 is applied, while the printing paper 213 passes between the photoreceptor 201 and the transfer device 209.

The image transferred to the printing paper passes through a high-temperature and high-pressure fixing device (not shown) and the image is fixed by fusing the toner 208 to the printing paper. Meanwhile, a non-developed residual toner 208' on the developing roller 205 is collected by the supplying roller 206 in contact with the developing roller 205, and the non-developed residual toner 208' on the photoreceptor 201 is collected by a cleaning blade 210. The processes described above are repeated.

Hereinafter, the present disclosure will be described in more detail according to Examples, but the present disclosure is not limited thereto.

EXAMPLES

Molecular weights, glass transition temperatures (Tg) of the low molecular weight amorphous polyester resins (LA-1 to LA-4), high molecular weight amorphous polyester resins (HA-1 to HA-4) and crystalline polyester resins (C-1 to C-3) used in the Preparation Examples below are the same as those shown in the following Tables 2 through 4.

TABLE 2

| Low molecular weight amorphous polyester resins | Mw (g/mol) | Glass transition temperature (° C.) |
|---|---|---|
| LA-1 | $11.4 \times 10^3$ | 59 |
| LA-2 | $9.7 \times 10^3$ | 57 |
| LA-3 | $19.2 \times 10^3$ | 64 |
| LA-4 | $7.8 \times 10^3$ | 54 |

TABLE 3

| High molecular weight amorphous polyester resins | Mw (g/mol) | Glass transition temperature (° C.) |
|---|---|---|
| HA-1 | $40.3 \times 10^3$ | 58 |
| HA-2 | $45.1 \times 10^3$ | 60 |
| HA-3 | $27.1 \times 10^3$ | 62 |
| HA-4 | $79.1 \times 10^3$ | 74 |

TABLE 4

| Crystalline polyester resins | Mw (g/mol) | Melting temperature (° C.) |
|---|---|---|
| C-1 | $10.0 \times 10^3$ | 62 |
| C-2 | $12.3 \times 10^3$ | 66 |
| C-3 | $24.4 \times 10^3$ | 73 |

The glass transition temperatures of the amorphous polyester resins and the melting temperature of the crystalline polyester resins are measured according to methods described below. Mw represents a weight-average molecular weight of the polyester resin measured by using a gel permeation chromatography (GPC) method on a tetrahydrofuran (THF) soluble fraction.

Preparation Example 1

Preparation of Low Molecular Weight Amorphous Polyester Latex LA-1

About 400 g of the low molecular weight amorphous polyester LA-1, about 600 g of methyl ethyl ketone (MEK) and about 100 g of isopropyl alcohol (IPA) were put into a 3 L double jacketed reactor. The LA-1 resin was dissolved by stirring with a semi-moon type impeller at about 30° C. 30 g of a 5% aqueous ammonia solution was gradually added while stirring the resin solution thus obtained, and thereafter, an emulsion was prepared by adding about 1,500 g of water at the rate of about 20 g/min while continuously stirring. Latex LA-1 having the solid concentration of about 20% was obtained by removing the solvents from the prepared emulsion by a vacuum distillation method.

Preparation Examples 2-4

Preparation of Low Molecular Weight Amorphous Polyester Latexes LA-2 to LA-4

Except for changing to one of the low molecular weight amorphous polyesters LA-2 to LA-4 instead of the low molecular weight amorphous polyester LA-1 and changing the added amount of the 5% aqueous ammonia solution a little bit in order to have the pH of about 7-8, the low molecular weight amorphous polyester latexes LA-2 to LA-4 are obtained in the same manner as Preparation Example 1.

Preparation Example 5

Preparation of High Molecular Weight Amorphous Polyester Latex HA-1

About 400 g of the high molecular weight amorphous polyester HA-1, about 500 g of MEK and about 200 g of IPA were put into a 3 L double jacketed reactor. The HA-1 resin was dissolved by stirring with a semi-moon type impeller at 30° C. 30 g of a 5% aqueous ammonia solution was gradually added while stirring the resin solution thus obtained, and thereafter, an emulsion was prepared by adding about 1,500 g of water at the rate of about 20 g/min while continuously stirring. Latex HA-1 having the solid concentration of about 20% was obtained by removing the solvents from the prepared emulsion by a vacuum distillation method.

Preparation Examples 6-8

Preparation of High Molecular Weight Amorphous Polyester Latexes HA-2 to HA-4

Except for changing to one of the high molecular weight amorphous polyesters HA-2 to HA-4 instead of the high molecular weight amorphous polyester HA-1 and changing the added amount of the 5% aqueous ammonia solution a little bit in order to have the pH of about 7-8, the low molecular weight amorphous polyester latexes HA-2 to HA-4 are obtained in the same manner as Preparation Example 5.

Preparation Example 9

Preparation of Crystalline Polyester Latex C-1

About 400 g of the crystalline polyester C-1, about 300 g of MEK and about 100 g of isopropyl alcohol (IPA) were put into a 3 L double jacketed reactor. The C-1 resin was dissolved by stirring with a semi-moon type impeller at 30° C. 30 g of a 5% aqueous ammonia solution was gradually added while stirring the resin solution thus obtained, and thereafter, an emulsion was prepared by adding about 2,500 g of water at the rate of about 20 g/min while continuously stirring. Latex C-1 having the solid concentration of about 15% was obtained by removing the solvents from the prepared emulsion by a vacuum distillation method.

Preparation Examples 10-11

Preparation of Crystalline Polyester Latexes C-2 and C-3

Except for changing to the crystalline polyesters C-2 and C-3 instead of the crystalline polyester C-1 and changing the added amount of the 5% aqueous ammonia solution a little bit in order to have the pH of about 7-8, the crystalline polyester latexes C-2 and C-3 are obtained in the same manner as Preparation Example 9.

Preparation Example 12

Preparation of Colorant Dispersion

A total of 10 g of an anionic reactive emulsifier (HS-10, DAICHI KOGYO) and a non-ionic reactive emulsifier (RN-10, DAICHI KOGYO) were taken at the ratio as shown in the following Table, and put into a milling bath together with about 60 g of cyan pigment (PB 15:4). After putting about 400 g of glass beads having a diameter of about 0.8-1 mm into the milling bath, a colorant dispersion was prepared by milling at room temperature. A sonifier or microfluidizer may be used as a disperser.

TABLE 5

| Color | Pigment | HS-10:RN-10 (Mixing weight ratio) |
|---|---|---|
| Cyan | PB 15:4 | 100:0 |
| | | 80:20 |
| | | 70:30 |

[Wax Dispersion]

SELOSOL P-212 (about 50-70 wt % of paraffin wax, about 30-50 wt % of synthetic ester wax, Tm 72° C., viscosity of about 9 mPa·s at 25° C.) provided from CHUKYO YUSHI CO., LTD. was used as a wax dispersion.

Example 1

Preparation of Aggregated Toner

About 764 g of deionized water, about 351 g of LA-1 latex, about 351 g of HA-1 latex, and about 112 g of C-1 latex were put in a 3 L reactor and stirred at about 350 rpm. After putting about 77 g of the cyan pigment dispersion (HS-10 100%) prepared in Preparation Example 12 and about 80 g of the wax dispersive solution SELOSOL P-212 in a reactor, about 30 g (0.3 mol) of nitric acid having the concentration of about 0.3 N and about 25 g of PSI-100 (SUIDO KIKO KAISHA LTD.) as a coagulant were further added in the reactor, and heated up to about 50° C. at the rate of about 1° C./min. while stirring using a homogenizer. Thereafter, an aggregation reaction was continuously performed while increasing the temperature of the aggregation reaction solution at the rate of about 0.03° C./minute, and primary aggregated toner particles having a volume average particle diameter of about 4-5 μm was formed.

Subsequently, after adding in the reactor a total of 300 g of the LA-1 latex and the HA-1 latex (1:1 weight ratio) prepared for forming a shell layer and aggregating for about 0.5 hours, the pH of the system was adjusted to about 7.5-9 by adding an aqueous solution of 1N NaOH. After about 20 minutes, secondary aggregated toner particles having the volume average particle diameter of about 5-7 μm were obtained by increasing the temperature of the system to about 80-90° C. and fusing the primary aggregated toner particles for about 3-5 hours. This aggregation reaction solution was cooled below about 28° C., and then, toner particles were separated through a filtering process and dried.

External additives were added to the toner particles by adding about 100 g of the dried toner particles, about 0.5 g of NX-90 (Nippon Aerosil), about 0.1 g of RX-200 (Nippon Aerosil), and about 0.5 g of SW-100 (Titan Kogyo) in a mixer (KM-LS2K, Dae Wha Tech), and stirring the toner particles and the external additives at about 8,000 rpm for about 4 minutes. Accordingly, toner having the volume average particle diameter of about 5-7 μm was obtained. Values of GSDv and GSDp of the toner particles were about 1.25 and about 1.30, respectively. Also, average circularity of the toner was about 0.972.

Examples 2-4 and Comparative Examples 1-9

Preparation of Aggregated Toner

Toner particles were prepared while a mixing weight ratio of the low and high molecular weight amorphous polyester resin latexes to the crystalline polyester resin latex was changed in order to have values presented in Table 6. Here, the toner particles were prepared so that all the values of [Si]/[Fe], a volume average particle diameter, average circularity, GSDv, and GSDp of the final toners obtained in Examples 1-4 and Comparative Examples 1-9 fall within a quality range of more than a certain level as described above.

TABLE 6

| | Toner No. | Low molecular weight amorphous resins | High molecular weight amorphous resins | Crystalline resins | $[\alpha_L]/[\alpha_H]$ | $([\alpha_L]+[\alpha_H])/[\beta]$ | $\log M_H - \log M_L$ |
|---|---|---|---|---|---|---|---|
| E 1 | 1 | LA-1 | HA-1 | C-1 | 1 | 9 | 0.5484 |
| E 2 | 2 | LA-2 | HA-2 | C-2 | 2.33 | 7.33 | 0.6674 |
| E 3 | 3 | LA-1 | HA-2 | C-2 | 3.84 | 17.6 | 0.5972 |
| E 4 | 4 | LA-2 | HA-1 | C-1 | 1.75 | 5.67 | 0.6185 |
| CE 1 | 5 | LA-4 | HA-1 | C-2 | 1.14 | 17.2 | 0.7132 |
| CE 2 | 6 | LA-2 | HA-2 | C-2 | 0.43 | 7.33 | 0.6674 |
| CE 3 | 7 | LA-2 | HA-1 | C-1 | 1.75 | 1.86 | 0.6185 |
| CE 4 | 8 | LA-1 | HA-3 | C-3 | 0.82 | 32.3 | 0.3760 |
| CE 5 | 9 | LA-1 | HA-1 | C-2 | 2.53 | 1.86 | 0.5484 |
| CE 6 | 10 | LA-4 | HA-2 | C-3 | 2.1 | 10.4 | 0.7620 |
| CE 7 | 11 | LA-2 | HA-3 | C-1 | 0.43 | 1.94 | 0.3760 |
| CE 8 | 12 | LA-4 | HA-4 | C-2 | 4.88 | 7.3 | 1.006 |
| CE 9 | 13 | LA-3 | HA-3 | C-1 | 1.5 | 8.8 | 0.1496 |

E: Example
CE: Comparative Example

The following Table 7 presents the results of evaluating properties of the toners 1 to 13 obtained in the Examples and Comparative Examples using the evaluating methods described below.

low-temperature fixing property. Particularly, a fusing latitude was narrow and a hot offset temperature (HOT) was generally low.

Evaluation Method of Toner

<Rheological Property Evaluation>

Rheological properties of the toners, i.e., G'(40° C.), G'(50° C.) or the like are obtained by measuring storage moduli (Pa) at temperatures of 40° C., 50° C. or the like according to a sine wave vibration method with measuring conditions including the frequency of 6.28 rad/s and the heating rate of 2.0° C./min using a dynamic mechanical analyzer (DMA, TA ARES) manufactured from Rheometric Scientific, Inc. At this time, the angular velocity of 6.28 rad/s is a setting value based on a fixation speed of a typical fixing unit. Values of Sκ, Sλ, Sλ/Sκ, Sσ, Sτ, Tp, and G'p are calculated from the measured values of G'(40° C.) and G'(50° C.), etc.

<Fixing Property Evaluation>

A test image was fixed with the following conditions using a belt-type fixing unit (manufacturer: Samsung Electronics Co., Ltd, model: Fixing unit of color laser printer 660 model).

Unfixed image for a test: 100% solid pattern

Test temperature: 100-180° C. (10° C. interval)

Test paper: 60 g paper (Boise, Inc., X-9)

Fixation speed: 160 mm/sec

Dwell time: 0.08 sec.

Fixability of a fixed image was evaluated as follows: After measuring optical density (OD) of the fixed image, 3M 810 tape was adhered to a portion of the image and the tape was removed after reciprocating five times using a 500 g weight. The optical density (OD) was measured after removing the tape.

TABLE 7

| | Sκ | Sλ | Sλ/Sκ | Sσ | Sτ | Tp (° C.) | Gp' ($\times 10^5$ Pa) | Gloss | Fusing latitude MFT (° C.) | Fusing latitude HOT (° C.) | Chargeability Charge stability | Chargeability HH/LL | Heat storage ability | Fluidity |
|---|---|---|---|---|---|---|---|---|---|---|---|---|---|---|
| E 1 | 0.016 | 0.12 | 7.50 | 0.14 | 0.09 | 75 | 3.1 | 10.8 | 118 | 200 or more | ○ | ○ | ○ | ◎ |
| E 2 | 0.036 | 0.14 | 3.89 | 0.15 | 0.08 | 73 | 2.2 | 13.1 | 113 | 190 | ○ | ○ | ○ | ◎ |
| E 3 | 0.024 | 0.07 | 2.92 | 0.11 | 0.08 | 77 | 4.5 | 12.8 | 120 | 190 | ○ | ○ | ○ | ◎ |
| E 4 | 0.030 | 0.18 | 6.00 | 0.17 | 0.07 | 71 | 1.4 | 13.4 | 110 | 195 | ○ | ○ | ○ | ◎ |
| CE 1 | 0.041 | 0.09 | 2.19 | 0.11 | 0.11 | 78 | 4.7 | 12.1 | 121 | 185 | ○ | Δ | Δ | ◎ |
| CE 2 | 0.009 | 0.06 | 6.67 | 0.12 | 0.14 | 82 | 6.8 | 7.7 | 138 | 200 or more | Δ | Δ | ○ | ○ |
| CE 3 | 0.031 | 0.25 | 8.06 | 0.21 | 0.08 | 76 | 5.3 | 10.8 | 125 | 180 | X | Δ | Δ | ○ |
| CE 4 | 0.010 | 0.07 | 7.00 | 0.07 | 0.11 | 82 | 5.9 | 9.2 | 132 | 190 | ○ | ○ | ○ | ○ |
| CE 5 | 0.021 | 0.24 | 11.43 | 0.15 | 0.08 | 77 | 5.4 | 11.3 | 126 | 185 | X | X | Δ | X |
| CE 6 | 0.044 | 0.10 | 2.27 | 0.10 | 0.09 | 83 | 7.1 | 9.3 | 135 | 195 | ○ | Δ | X | Δ |
| CE 7 | 0.09 | 0.20 | 2.22 | 0.20 | 0.13 | 79 | 6.4 | 8.1 | 140 | 200 or more | X | Δ | Δ | ◎ |
| CE 8 | 0.049 | 0.09 | 1.84 | 0.11 | 0.12 | 79 | 6.2 | 8.9 | 138 | 120 | Δ | Δ | Δ | Δ |
| CE 9 | 0.009 | 0.07 | 7.78 | 0.12 | 0.10 | 80 | 6.3 | 7.8 | 135 | 120 | ○ | ○ | ○ | ◎ |

MFT: Minimum fusing temperature
HOT: Hot offset temperature

Referring to Table 7, the toners of Examples 1-4 exhibited appropriate values in terms of rheological behavior, particularly shear storage modulus and slope, at each temperature range, while simultaneously satisfying the characteristics of gloss, tribo-charging stability, fluidity, storage stability, and low-temperature fixing property, etc. Particularly, a fusing latitude was wide. In contrast, the toners of Comparatives Examples 1-9, in which at least any one of the values of Sκ, Sλ, Sλ/Sκ, Sσ, Sτ, Tp, and G'p does not fall in the range of the present disclosure, exhibited a poor result in at least one of gloss, tribo-charging stability, fluidity, storage stability, and Fixability was evaluated by the following equation:

$$\text{Fixability (\%)} = (\text{optical density after tape peeling} / \text{optical density before tape peeling}) \times 100.$$

A fixing temperature range having a fixability value of 90% or more was regarded as a fixing range of a toner. A minimum temperature having the fixability value of 90% or more without cold-offset was defined as a minimum fusing temperature (MFT). A minimum temperature at which hot-offset occurs was defined as a hot offset temperature (HOT).

<Gloss Evaluation>

Gloss (%) was measured at the temperature of the fixing unit of 160° C. using a gloss measuring instrument, a glossmeter (manufacturer: BYK Gardner, Product name: micro-TRI-gloss).

Measurement angle: 60°

Measurement pattern: 100% solid pattern.

<Heat Storage Ability>

About 100 g of a toner was put into a developer (manufacturer: Samsung Electronics Co., Ltd, model: developer of color laser 660 model) and stored in packaged state in a constant temperature and humidity oven under the following conditions:

23° C., 55% relative humidity (RH), 2 hours

40° C., 90% RH, 48 hours

50° C., 80% RH, 48 hours

40° C., 90% RH, 48 hours

23° C., 55% RH, 6 hours

After storing under the above conditions, the presence of toner caking in the developer was identified with the naked eye and image defects were evaluated by printing a 100% solid pattern.

Evaluation Criteria

○: Good image, no caking

Δ: Inferior image, no caking

X: Occurrence of caking

<Toner Fluidity Evaluation (Carr's Cohesion)>

The conditions for toner fluidity evaluation were as follows:

Instrument: Hosokawa micron powder tester PT-S

Sample amount: 2 g (toner having external additive or no external additive)

Amplitude: 1 mm dial 3-3.5

Sieve: 53, 45, 38 μm

Vibration time: 120 seconds.

After the sample toner was stored at about 23° C. and 55% RH for about 2 hours, the sample toner was sieved using each of the three sieves. Masses of toner powders remaining on each of the three sieves were measured under the above conditions to calculate the aggregation of toner as follows.

[(mass of powders remaining on 53 μm sieve)/2 g]×100

[(mass of powders remaining on 45 μm sieve)/2 g]×100×(3/5)

[(mass of powders remaining on 38 μm sieve)/2 g]×100×(1/5)

Degree of aggregation (Carr's cohesion)=(1)+(2)+(3)

From the value of the degree of aggregation, the fluidity of the toner was evaluated with the following criteria.

Evaluation Criteria of Fluidity

◎: Vastly superior fluidity, having a degree of aggregation of less than 10

○: Satisfactory fluidity, having a degree of aggregation of 10-20

Δ: Inferior fluidity, having a degree of aggregation greater than 20 to 40 or less X: Vastly inferior fluidity, having a degree of aggregation of greater than 40.

<Charging Property Evaluation of Toner>

About 28.5 g of magnetic material carriers (KDK, model: SY129) and about 1.5 g of a toner were added in a 60 ml glass container and then stirred using a tubular mixer. Then, the charge quantity of the toner was measured using an electric field separation method.

Under room temperature and room humidity conditions (23° C., 55% RH), a charge stability of the toner according to stirring time was evaluated.

Room temperature and room humidity: 23° C., 55% RH

High temperature and high humidity (HH): 30° C., 82% RH

Low temperature and low humidity (LL): 10° C., 10% RH

Charge stability was evaluated under the room temperature and room humidity conditions as follows.

○: the case where a charge saturation curve according to stirring time is smooth and the fluctuation range thereof is insignificant after charge saturation.

Δ: the case where a charge saturation curve according to stirring time is a little fluctuated and the fluctuation range thereof is small after charge saturation (up to 30%).

X: the case where charge according to stirring time is not saturated and the fluctuation range thereof is considerably large after charge saturation (greater than 30%).

Also, the ratio of high temperature and high humidity/low temperature and low humidity charge quantities (HH/LL ratio) was evaluated as charge stability according to environmental change.

○: HH/LL ratio of greater than 0.55

Δ: HH/LL ratio of 0.45-0.55

X: HH/LL ratio of less than 0.55

<Average Circularity Evaluation>

The shape of the prepared toners was identified with SEM photographs. The circularity of the toner was calculated based on the following formula using FPIA-3000 from SYSMEX Corporation.

$$\text{Circularity}=2\times(\pi\times\text{area})^{0.5}/\text{circumference} \quad \text{<Formula>}$$

A value of circularity is in the range of 0 to 1, and a toner particle becomes spherically shaped as the value of circularity approaches 1. The average circularity was calculated by averaging circularity values of 3,000 toner particles.

<Particle Size Distribution Evaluation>

A volume average particle size distribution index GSDv and a number average particle size distribution index GSDp, which are particle size distribution indices of toner particles, were measured under the following conditions using a Multisizer III measuring instrument (from Beckman Coulter, Inc) which is a Coulter counter.

Electrolyte: ISOTON II

Aperture Tube: 100 μm

Measured particle number: 30000

From the measured particle size distribution of the toner, a cumulative distribution for volume and number of individual toner particles was plotted as a divided particle size range (i.e., channel) in order of increasing diameter. A particle diameter at cumulative 16% is defined as volume average particle size D16v and number average particle size D16p, and a diameter at cumulative 50% is defined as volume average particle size D50v and number average particle size D50p. Similarly, a particle diameter at cumulative 84% is defined as volume average particle size D84v and number average particle size D84p. GSDv and GSDp are calculated by using the following equations.

$$GSDv=(D84v/D16v)^{0.5}$$

$$GSDp=(D84p/D16p)^{0.5.}$$

According to exemplary embodiments of the present disclosure, a certain level of characteristics such as low-temperature fixability, charge stability, fluidity, heat storage ability, wide color gamut, and gloss may be achieved. Therefore, excellent image characteristics may be achieved, a wide fixing region may be secured, and a toner having improved durability may be prepared.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A toner for developing an electrostatic charge image comprising:

a core layer including a first binder resin, a colorant and a releasing agent; and a shell layer coating the core layer and including a second binder resin, wherein the first binder resin of the core layer comprises a low molecular weight amorphous polyester resin having a weight-average molecular weight of about 6000 g/mol to about 20000 g/mol, a high molecular weight amorphous polyester resin having a weight-average molecular weight of about 25000 g/mol to about 100000 g/mol, and a crystalline polyester resin having a weight-average molecular weight of about 8000 g/mol to about 30000 g/mol, the second binder resin of the shell layer comprises the low and high molecular weight amorphous polyester resins, and the toner exhibits a rheological behavior satisfying the following equations (1), (2) and (3) according to a temperature change:

$$0.01<S\kappa<0.04, 0.05<S\lambda<0.2, \text{ and } 2<S\lambda/S\kappa<20, \quad (1)$$

where, $S\kappa=[\log G'(40° C.)-\log G'(50° C.)]/10$ and $S\lambda=[\log G'(50° C.)-\log G'(60° C.)]/10$, $$0.1<S\sigma<0.2 \text{ and } 0.06<S\tau<0.1, \quad (2)$$

where, $S\sigma=[\log G'(60° C.)-\log G'(70° C.)]/10$ and $S\tau=[\log G'(70° C.)-\log G'(80° C.)]/10$, and $$70° C.<Tp<80° C., 1\times10^5 \text{ Pa}<G'p<5\times10^5 \text{ Pa}, \quad (3)$$

where, Tp denotes a temperature satisfying a condition (a p condition) of $S\sigma/S\tau>1$, G'p denotes a shear storage modulus at a temperature satisfying the p condition, and G'(temperature) denotes a shear storage modulus (unit: Pa) measured under conditions including a measurement frequency of about 6.28 rad/s, a heating rate of about 2.0° C./min, an initial strain of about 0.3% and an indicated temperature;

wherein the binder resins have a mixing ratio satisfying a condition of the following equation (4);

$$1<[\alpha_L]/[\alpha_H]<4 \text{ and } 2<([\alpha_L]+[\alpha_H])/[\beta]<30 \quad (4)$$

where, $[\alpha_L]$ and $[\alpha]_H$ denote weights of the high molecular weight amorphous polyester resin and the low molecular weight amorphous polyester resin in the toner, respectively, $[\beta]$ denotes a weight of the crystalline polyester resin in the toner.

2. The toner of claim 1, wherein the high molecular weight amorphous polyester resin and the low molecular weight amorphous polyester resin have a molecular weight difference satisfying a condition of the following equation (5):

$$0.3<(\log M_H-\log M_L)<1, \quad (5)$$

where, $M_H$ and $M_L$ are weight-average molecular weights of the high molecular weight amorphous polyester resin and the low molecular weight amorphous polyester resin, respectively.

3. The toner of claim 1, wherein the toner exhibits a rheological behavior further satisfying a condition of the following equation (6) according to a temperature change:

$$0<[\log G'(120° C.)-\log G'(140° C.)]/20<0.05. \quad (6)$$

4. The toner of claim 1, wherein the toner has a weight-average molecular weight of about 20000 g/mol to about 60000 g/mol determined from a molecular weight measurement by using a gel permeation chromatography (GPC) method on a tetrahydrofuran (THF) soluble fraction.

5. The toner of claim 1, wherein a volume average particle diameter of the toner is in a range of about 3 μm to about 9.5 μm.

6. The toner of claim 1, wherein an average circularity of the toner is in a range of about 0.940 to about 0.985.

7. The toner of claim 1, wherein values of a volume average particle size distribution index (GSDv) and a number average particle size distribution index (GSDp) of the toner are about 1.25 or less and about 1.30 or less, respectively.

8. The toner of claim 1, wherein the releasing agent comprises a paraffin-based wax and an ester-based wax, a weight ratio of the ester-based wax is in a range of about 1 wt % to about 50 wt % based on a total weight of the paraffin-based wax and the ester-based wax, and solubility parameter (SP) values of the binder resins have a difference of 2 or more when compared with SP values of the paraffin-based wax and the ester-based wax.

9. The toner of claim 1, wherein the toner further comprises a coagulant including silicon (Si) and iron (Fe), and when a silicon intensity and an iron intensity determined by X-ray fluorescence (XRF) measurements are denoted as [Si] and [Fe], a [Si]/[Fe] ratio of the toner satisfies the following condition (7):

$$0.0005\leq[Si]/[Fe]\leq0.05. \quad (7)$$

10. The toner of claim 1, wherein the toner particles have less than about 3 wt % of fine particles with a diameter of less than about 3 inn, and less than about 0.5 wt % of coarse particles with a diameter of about 16 μm or more.

11. A toner supply device comprising:

a toner tank to store a toner;

a supplying part protruding toward an inner side of the toner tank to supply the stored toner to outside; and a toner stirring member rotatably installed inside the toner tank and configured to stir the toner in an entire inner space of the toner tank including an upper portion of the supplying part, wherein the toner is for developing an electrostatic charge image according to claim 1.

12. An apparatus for forming an image, the apparatus comprising:

an image carrier;

an image forming device forming a latent image on a surface of the image carrier;

a toner storage device to store a toner;

a toner supply device to supply the toner to the surface of the image carrier to develop the latent image to a toner image on the surface of the image carrier; and a toner transfer device to transfer the toner image from the surface of the image carrier to an image receiving member, wherein the toner is for developing an electrostatic charge image according to claim 1.

13. A method of forming an image, the method comprising adhering a toner to a surface of an image carrier on which an electrostatic latent image is formed to form a visible image and transferring the visible image to an image receiving member, wherein the toner is for developing an electrostatic charge image according to claim 1.

14. A method of preparing a toner for developing an electrostatic charge image, the method comprising:

preparing a mixture by mixing a first binder resin latex, a colorant, and a releasing agent, wherein the first binder resin comprises a low molecular weight amorphous polyester resin having a weight-average molecular weight of about 6000 g/mol to about 20000 g/mol, a high molecular weight amorphous polyester resin having a weight-average molecular weight of about 25000 g/mol to about 100000 g/mol, and a crystalline polyester resin having a weight-average molecular weight of about 8000 g/mol to about 30000 g/mol;

adding a coagulant into the mixture to form core particles including the first binder resin, the colorant and the releasing agent;

forming shell layers on the core particles by adding a second binder resin latex in a dispersion of the core particles and adhering the second binder resin on surfaces of the core particles to form fine particles comprising the core and shell layers, wherein the second binder resin comprises the low and high molecular weight amorphous polyester resins;

additionally aggregating the fine particles until an average particle size of the fine particles reaches a range of about 70% to about 100% of an average target particle diameter of final toner particles;

coalescing the aggregated fine particles in a temperature range of about 20° C. to about 50° C. higher than a glass transition temperature (Tg) of the amorphous polyesters; and obtaining a final toner by further aggregating and coalescing the fine particles in a temperature range of Tg of the amorphous polyesters or less, wherein the low molecular weight amorphous polyester resin, the high molecular weight amorphous polyester resin and the crystalline polyester resin satisfy the following mixing ratio when forming the core and shell layers by using the first and second binder resin latexes:

$$1<[\alpha_L]/[\alpha_H]<4 \text{ and } 2<([\alpha_L]+[\alpha_H])/[\beta]<30,$$

where, $[\alpha_L]$ and $[\alpha_H]$ denote weights of the high molecular weight amorphous polyester resin and the low molecular weight amorphous polyester resin in the toner, respectively, and $[\beta]$ denotes a weight of the crystalline polyester resin in the toner.

15. The method of claim 14, wherein the final toner exhibits a rheological behavior satisfying the following equations (1), (2) and (3) according to a temperature change:

$$0.01<S\kappa<0.04, 0.05<S\lambda<0.2, \text{ and } 2<S\lambda/S\kappa<20, \quad (1)$$

where, $S\kappa=[\log G'(40° C.)-\log G'(50° C.)]/10$ and $S\lambda=[\log G'(50° C.)-\log G'(60° C.)]/10$, $$0.1<S\sigma<0.2 \text{ and } 0.06<S\tau<0.1, \quad (2)$$

where, $S\sigma=[\log G'(60° C.)-\log G'(70° C.)]/10$ and $S\tau=[\log G'(70° C.)-\log G'(80° C.)]/10$, and $$70° C.<Tp<80° C., 1\times10^5 \text{ Pa}<G'p<5\times10^5 \text{ Pa}, \quad (3)$$

where, Tp denotes a temperature satisfying a condition (a p condition) of $S\sigma/S\tau>1$, G'p denotes a shear storage modulus at a temperature satisfying the p condition, and G'(temperature) denotes a shear storage modulus (unit: Pa) measured under conditions including an angular velocity of about 6.28 rad/s, a heating rate of about 2.0° C./min, and an indicated temperature.

16. The method of claim 15, wherein the toner exhibits a rheological behavior further satisfying a condition of the following equation (6) according to a temperature change:

$$0<[\log G'(120° C.)-\log G'(140° C.)]/20<0.05. \quad (6)$$

17. The method of claim 14, wherein the high molecular weight amorphous polyester resin and the low molecular weight amorphous polyester resin have a molecular weight difference further satisfying a condition of the following equation (5):

$$0.3<(\log M_H-\log M_L)<1, \quad (5)$$

where, $M_H$ and $M_L$ are weight-average molecular weights of the high molecular weight amorphous polyester resin and the low molecular weight amorphous polyester resin, respectively.

* * * * *

UNITED STATES PATENT AND TRADEMARK OFFICE

CERTIFICATE OF CORRECTION

PATENT NO. : 8,642,239 B2
APPLICATION NO. : 13/347141
DATED : February 4, 2014
INVENTOR(S) : Hong et al.

It is certified that error appears in the above-identified patent and that said Letters Patent is hereby corrected as shown below:

In the Claims

Column 30, Line 40, In Claim 10, delete "3 inn," and insert -- 3 μm, --, therefor.

Signed and Sealed this
First Day of July, 2014

Michelle K. Lee

Michelle K. Lee
*Deputy Director of the United States Patent and Trademark Office*